United States Patent [19]

De Lucia

[11] 4,033,155

[45] July 5, 1977

[54] PADLOCK PROTECTING DEVICE

[76] Inventor: Jerry S. De Lucia, 1013 Revere Ave., Bronx, N.Y. 10465

[22] Filed: May 24, 1976

[21] Appl. No.: 689,654

[52] U.S. Cl. ..... 70/56; 70/417

[51] Int. Cl.[2] ..... E05B 67/38

[58] Field of Search ..... 70/54, 55, 56, 416, 70/417, 418; 292/281

[56] References Cited

UNITED STATES PATENTS

| | | | |
|---|---|---|---|
| 104,441 | 6/1870 | Gale | 70/55 X |
| 3,590,607 | 7/1971 | Beaver | 70/56 |
| 3,718,014 | 2/1973 | Delgedillo | 70/56 |
| 3,828,591 | 8/1974 | Beaver | 70/56 |

*Primary Examiner*—Robert L. Wolfe
*Attorney, Agent, or Firm*—Bauer, Amer & King

[57] ABSTRACT

A protective device for use in combination with a padlock in securing first and second members, wherein a hasp is secured to one member and a staple to the other, has a rear wall with a staple receiving slot, front and side walls and internal cross-member. The front wall has a protruding lower edge and further depending front wall. The cross-member is trough shaped to receive the staple. A shim may be used in conjunction with the device to snugly secure the padlock within.

2 Claims, 6 Drawing Figures

PADLOCK PROTECTING DEVICE

BACKGROUND OF THE INVENTION

This invention relates to a burglar-proof padlock protecting device and more particularly to a padlock protector or shield capable of enclosing a padlock shackle, hasp and staple in such a manner that they cannot be readily tampered or assaulted with instruments such as sledge hammers, bolt cutters, chisels and prying bars.

Another object of the invention is to provide a padlock protecting device adaptable for direct attachment upon a hasp such that upon fitting the hasp over a staple and securing with a padlock, the protecting device shields the padlock from tampering and assault as mentioned above.

DESCRIPTION OF THE PRIOR ART

A widely used conventional locking combination for securing relatively movable members, such as a door and doorframe/wall consists of a hasp with a portion permanently fixed to one member and one side having a vertical slot through which a staple affixed to the other member can extend. A padlock is secured through the staple preventing removal of the staple from the hasp.

This locking combination exposes the staple and padlock to direct assault and tampering, thereby facilitating entry into areas secured by them after their breakage. In order to solve this problem and protect the hasp-staple-padlock combination from assault and tampering, several devices have been suggested for shielding the staple and hasp. However, most are bulky, require reworking of the existing system and, generally, have not met commercial success. Padlock covers are shown in U.S. Pat. Nos. 256,902 to G. E. Kirk; 547,550 to P. Hopkins; 1,244,404 to L. B. Ankovitz; 1,248,293 to T. H. Ellington; 3,718,014 to F. M. Delgadillo; and 3,916,654 to K. E. Mudge, Jr. However, the aforementioned prior art patents are merely shields against the weather and offer no protection against burglars.

SUMMARY OF THE INVENTION

In accordance with the present invention there is provided a locking device which provides protection without requiring the replacement or modification of the existing hasp-staple system. The present invention may be used in combination with conventional hasp-staple-padlock locking devices and is strong enough to withstand bolt cutters and sledge hammer attacks and prying and chiselling.

The protecting device for securing a hasp-staple-padlock combination consists of a protective hood having front and back walls, the rear wall having a staple receiving slot, a roof section intermediate the front and rear walls of their upper edges, an internal cavity formed thereby and an internal cross-member extending from the front to rear wall receiving the lower portion of the bottom of the staple. After the hasp slot is placed over the staple the protective device is mounted by placing the rear wall slot over the staple so the cross member cradles the lower staple portion. A padlock is inserted into the device and secured over the staple-cross-member combination. The protective device now shields the padlock-hasp-staple combination from attack. An alternative construction allows the user to directly affix the protector to the hasp. The protector is preferably constructed of a material with strong tensile-hardness characteristics, such as Manganese-Bronze No. 421.

Therefore, this invention provides a burglar-proof protective structure for use with a hasp-staple-padlock combination which is compatible with conventional hasp-staple systems and strong enough to withstand sledge hammer attack.

The above-description, as well as further objects, features and advantages of the present invention, will be more fully appreciated by reference to the following detailed description of a presently preferred, but, nonetheless illustrative, embodiment in accordance with the present invention when taken in conjunction with the accompanying drawings:

DESCRIPTION OF THE PREFERRED EMBODIMENT

Figure 1:
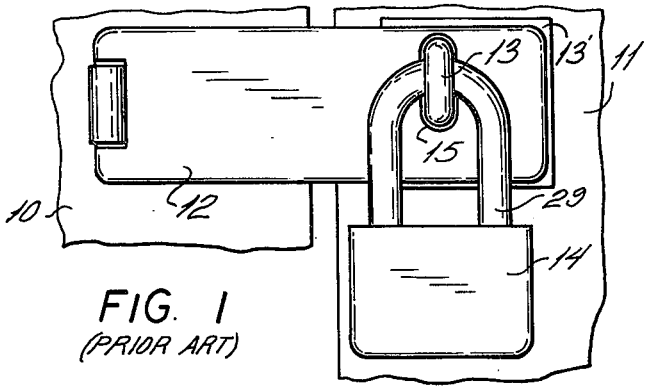
FIG. 1 (PRIOR ART)
FIG. 1 is a front view of a conventional, prior art, hasp-staple locking device.

Referring now to the drawings and, more particularly, to FIG. 1 thereof, one common type of conventional locking device for securing a door 10 to a wall 11 to prevent the unauthorized opening of door 10 includes a steel hasp 12, a staple 13 and a padlock 14. Staple 13 is attached to a plate 13' which is secured to the door frame by screws or other fastening means. One side of hasp 12 is attached, typically by screws or other fastening means to door 10 and the other side of hasp 12 has a slot 15 therein which receives and straddles staple 13 when door 10 is in the closed position, as shown. In such position, padlock 14 may be slipped over and secured to staple 13 thereby preventing removal of staple 13 from hasp 12.

Figure 2:
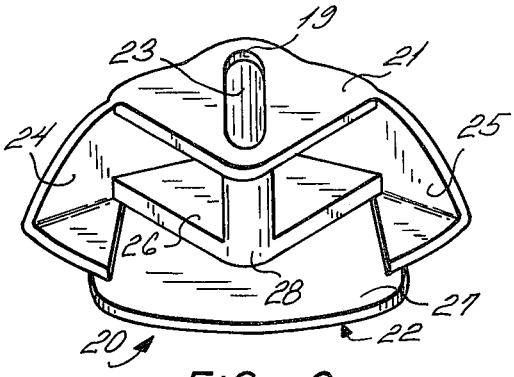
FIG. 2 is a perspective view of the padlock protecting device looking upwardly from the bottom.
Figure 3:
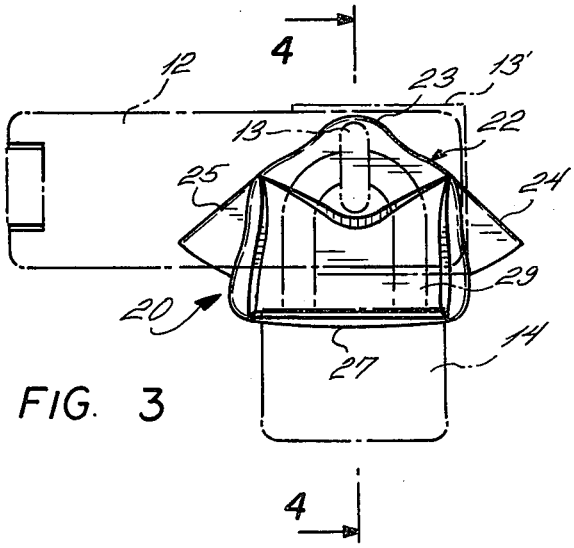
FIG. 3 is a front plan view of the padlock protecting device engaged with a hasp-staple-padlock combination wherein the staple and padlock shackle are shown in phantom.

Referring now to FIGS. 2 and 3, the present padlock protecting device, generally designated 20, is designed to shield staple 13 and padlock 14 from intruder attack and, therefore, make door 10 strong enough to resist such attack. Protecting device 20 has a planar back plate 21 having a staple receiving slot 19, having generally the same general dimensions as slot 15 in hasp 12, a protective front plate 22 shielding padlock 14 from frontal assault, a convexly rounded lid 23 which connects the top inner edges of the front and back plates and first and second side walls 24, 25 on either side of slot 19 shielding the padlock from sidewards assault. Front plate 22 has a protruding lip portion 26 which projects outward from the rear plate and an additional front plate 27 depending therefrom which shields padlock 14 from further frontal assault. Internal cross-member 28 connects the bottom center of front plate 22 at its border with protruding lip 26 with rear plate 21 immediately beneath staple receiving slot 19, thereby providing a trough to receive staple 13. Padlock 14 can be secured over both cross-member 28 and staple 13 and thereby secure the protective device to the hasp-staple combination.

Typically, each of plates 21–27 and cross-member 28 is made of a material, such as Manganese Bronze No. 421, which will resist damage by acetylene torch, or by implements such as sledge hammers, pry bars, chisels and bolt cutters, and is manufactured to form a seamless structure.

The length of member 28 will be greater than the diameter of the shackle 29 of padlock 14. A typical protecting device will have slightly more cross-member length than shackle width. To accommodate thinner shackles, a shim 30 can be slipped over the staple to limit movement of the protective device 20 away from the member 12 to prevent insertion of a pry bar.

Figure 4:
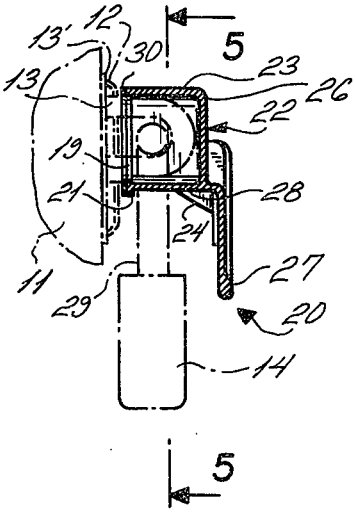
FIG. 4 is a vertical cross-section through lines 4—4 of FIG. 3.
Figure 5:
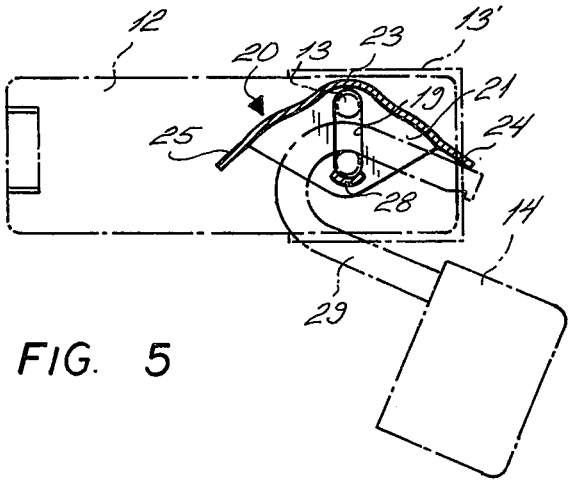
FIG. 5 is a vertical section taken along line 5—5 of FIG. 4.

Referring now to FIG. 4 a side cross-section, in operation, lid 23, front plates 22, 27, cross-member 28 and side wall 24 provide a protective hood for padlock 14 and shackle 29. Once padlock 14 is engaged, staple 13 may not be removed from hasp slot 15 or protective device slot 19 and door 10 may not be moved relative to wall 11. On the other hand, an authorized person can easily gain access by unlocking padlock 14 from the bottom.

Figure 6:
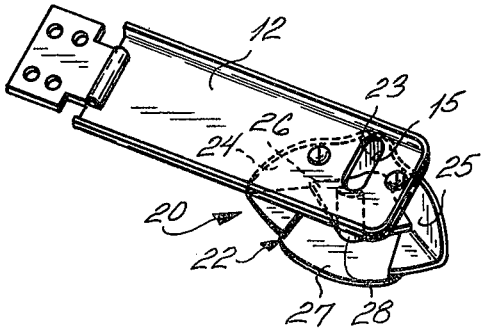
FIG. 6 is a perspective view showing the rear of a hasp with the protective device of this invention attached thereto.

An alternative embodiment of the invention is depicted in FIG. 6 wherein rear plate 21 is directly affixed to hasp 10. Such attachment may be effected by welding or, as shown, screwing together hasp 10 and rear plate 21, providing a permanent staple-padlock protective device by incorporating the device onto the hasp. For this purpose the rear plate may be eliminated. Alternatively, the device shown in FIG. 2 may be attached directly with slots 15 and 19 aligned.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the invention, therefore, to be limited only as indicated by the scope of the claims appended hereto.

What is claimed is:

1. A protecting device for use in combination with a padlock in securing first and second members wherein a hasp is secured to said first member and a staple is secured to said second member, comprising:

a hood-like member having dimensions suitable for containing said padlock and staple therein, said member containing a rear wall having a staple receiving slot adjacent a top thereof, said member having said top, front and first and second side walls, said front wall having a relatively perpendicular outwardly protruding lip at the bottom edge thereof and a depending further front wall from the front of the outwardly projecting lip and a cross-member extending from the inside rear wall beneath said staple receiving slot to the inside front wall interior of said protruding lip, said cross-member to abut the staple and be enclosed by said padlock.

2. A protecting device as in claim 1 wherein said cross-member is concavely rounded to receive snugly said staple.

* * * * *